United States Patent [19]

Rauch

[11] 3,993,160

[45] Nov. 23, 1976

[54] SILENCER FOR A HEAT ENGINE

[75] Inventor: Jean Rauch, Bart, France

[73] Assignees: Automobiles Peugeot, Paris; Regie Nationale des Usines Renault, Boulogne-Billancourt, both of France

[22] Filed: Oct. 22, 1975

[21] Appl. No.: 624,903

[30] Foreign Application Priority Data

Nov. 12, 1974 France ..... 74.37304
Mar. 3, 1975 France ..... 75.06550

[52] U.S. Cl. ..... 181/53; 181/44
[51] Int. Cl.[2] ..... F01N 1/04; F01N 1/06
[58] Field of Search ..... 181/33 L, 35 B, 42, 181/44–46, 49, 53, 54, 56

[56] References Cited

UNITED STATES PATENTS

| | | | |
|---|---|---|---|
| 2,109,220 | 2/1938 | Noblitt et al. | 181/44 X |
| 2,196,920 | 4/1940 | Hoyle | 181/53 X |
| 2,850,111 | 9/1958 | Nelson | 181/53 |
| 2,934,161 | 4/1960 | Powers | 181/53 |
| 2,960,179 | 11/1960 | Bryant | 181/53 X |
| 3,243,010 | 3/1966 | Flynn | 181/53 X |
| 3,741,336 | 6/1973 | Malosh | 181/54 |

*Primary Examiner*—Lawrence R. Franklin
*Attorney, Agent, or Firm*—Burns, Doane, Swecker & Mathis

[57] ABSTRACT

An outer return tube is provided outside an exhaust silencer case and forms part of means for interconnecting the downstream end of an upstream tube and the upstream end of a downstream tube with respect to the direction of travel of the exhaust gases through the silencer. The upstream tube and downstream tube are perforated and extend in the case. At least a fraction of the exhaust gas stream travels through the outer return tube.

17 Claims, 5 Drawing Figures

SILENCER FOR A HEAT ENGINE

Figure 1:
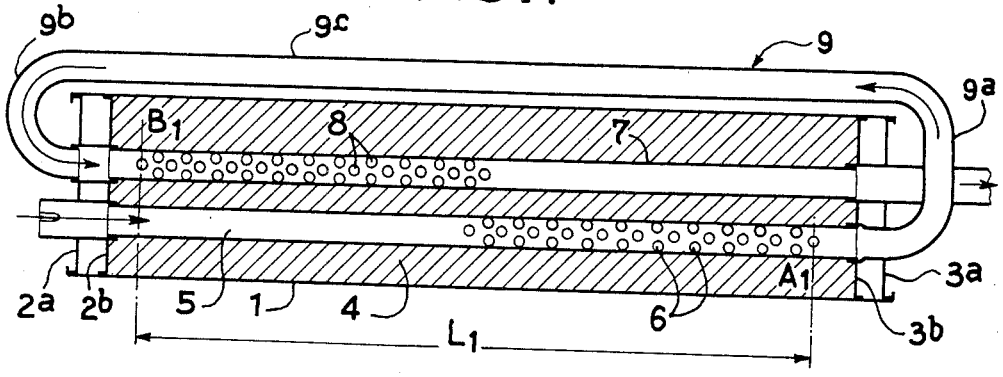

The present invention relates to exhaust silencers adapted to be placed in the exhaust pipes of internal combustion engines for vehicles or other machines.

It is known that the means for obtaining an acoustic attenuation employed in exhaust silencers mainly involve the following three principles: absorption, reflection and interference.

The silencer employing-absorption is in fact a low-pass filter in which the principally high frequency components are attenuated by a phenomenon of friction of a part of the fluid in an element composed of an absorbent material disposed around a perforated pipe.

The attenuation by reflection is achieved by combining one or more acoustic resistances with the piping so that the sound propagated therein is partly reflected, which results in a damping or muffling of the noise at the outlet of the system. There is no intention to enter into the details of this phenomenon here and it will merely be mentioned that a perforated pipe extending through the cavity of a case constitutes a multiple resonator, the number of elementary resonators being equal to the number of orifices provided in the pipe.

The principle of attenuation by interference consists in making a division of the wave or waves so as to incorporate the deviated fraction or fractions into the main stream only at the suitable moment and introducing between the main stream and each deviated fraction difference of travel which corresponds in fact to the difference between the lengths of the two paths travelled through by the two considered streams. There corresponds to each value of the difference of travel an optimal attenuation for a given frequency component, the value of the attenuated frequency being inversely proportional to the value of the difference of travel. It is therefore easier to attenuate by interference the high-pitch sounds (high frequency sounds) than the low-pitch sounds (low frequency sounds).

Silencers are employed at the present time in automobiles which combine at least two of the aforementioned effects, namely reflection and interference. These silencers comprise a case in which extend at least two parallel perforated tubes, namely an inlet tube or upstream tube, and an outlet tube or downstream tube, through which tubes the exhaust gases travel in series. These tubes communciate, on one hand, through orifices formed therein and through a first chamber defined in the case and constituting an inter-communication enclosure and, on the other hand, by way of a second chamber which is defined in the case and is termed the balancing chamber and into which the downstream end of the upstream tube and the upstream end of the downstream tube open. Bearing in mind the requirements as concerns overall size that silencers must satisfy, it has been attempted to increase their effectiveness in the attenuation of the low-pitch sounds by increasing the value of the maximum difference of travel capable of being obtained, in particular by multiplying the returns paths and, for example, by passing from one device with one return path and two tubes to devices having two return paths and three tubes or four return paths and five tubes. However, this tendency is not fully satisfactory since it has very serious drawbacks. In particular, this solution results in a very substantial increase in the pressure drop of the system. Now, it is known that the value of this pressure drop in the whole of the exhaust circuit has a direct influence on the efficiency of the engine. By way of example, the pressure drop increases by about 100 % when passing from a device having two return paths to a device having four return paths. Such an increase may be unacceptable. Added to this drawback is another drawback which results from the fact that the adoption of a system having more than two tubes per exhaust line results in increasing the volume of the chamber provided for each one of the tubes in proportions which may be unacceptable bearing in mind the resulting reduction in the attenuation by deflection. It also tends to reduce the possibility of placing in the same silencer other attenuation stages such as: resonators for the low frequencies high-frequency inlet and outlet stages etc...

This very brief summary shows that the problems to be resolved in this field are particularly complex and an object of the invention is to provide a silencer whereby it is possible to obtain within a given overall size a wide range of differences of travel of the waves so as to extend toward the low-pitch notes the frequency range in which the silencer is effective while reducing the pressure drop. These two conditions have been heretofore considered to be contradictory.

According to the invention, there is provided an exhaust silencer for a heat engine of the type comprising a closed case, at least two perforated tubes extending in said case and through which tubes the exhaust gases travel in series, wherein there is provided a return tube outside the case through which return tube at least a fraction of the flow of exhaust gas travels and which is so arranged as to put the downstream end of the upstream tube and the upstream end of the downstream tube in communication with each other.

The presence of this outer return tube through which at least a part of the gas flow is channelled permits substantially increasing the maximum difference of travel capable of being achieved while decreasing the pressure drop, as will be understood hereinafter. Moreover, in this definition the terms "upstream" and "downstream" applied to the tubes are intended to characterize the relative position of the two perforated tubes disposed in the case and connected by the outer return tube. These two terms therefore do not necessarily designate the tubes connected to the inlet and the outlet of the silencer.

In a first embodiment, the upstream and downstream tubes extend throughout the case and the outer return tube is directly connected between the downsteam end of the upstream tube and the upstream end of the downstream tube.

In a second embodiment, two balancing chambers and at least one intermediate or intercommunication chamber are provided in the case and the silencer comprises in the case, in addition to the upstream and downstream tubes, at least one intermediate tube, the downstream end of the upstream tube, the upstream end of the intermediate tube and the upstream end of the outer return tube opening into one of the balancing chambers, whereas the downstream end of the intermediate tube, the downstream end of the outer return tube and the upstream end of the downstream tube open into the second balancing chamber.

According to another embodiment, in order to obtain an improved range of the differences of travel, and a wider range of the frequencies concerned, a system employing interference and reflection is placed in the same case in series with the upstream tube which is connected to the outer return tube. This upstream tube may be itself preceded by two tubes placed in series and provided with suitable perforations.

The arrangement of the tubes, partition walls and perforations inside the case may be modified in many ways. But in certain applications the case may be at least partly filled with an absorbent material whereas in other applications the silencer is of the reflection type and is devoid of such a material.

The invention will be described in more detail hereinafter with reference to the accompanying drawings which are given solely by way of example in which FIGS. 1 to 5 are diagrammatic views of five embodiments of a silencer according to the invention.

FIG. 1 shows an end silencer, that is to say a silencer adapted to be placed in the vicinity of the outlet end of an exhaust pipe. This silencer comprises an outer case 1 closed at its two ends by a wall 2*a*, 3*a*, perforated partition walls 2*b*, 3*b* enabling an interfitting to be achieved at the inlet and outlet ends. The interior of the case between the walls 2*b*, 3*b* is filled with an absorbent material 4 which may be for example composed of stainless steel or aluminum fibre, or basalt wool having a volumic weight which is such that it ensures a perfect permeability to low notes, sufficient permeability to medium notes and low permeability to high notes. This silencer comprises an inlet or upstream tube 5 which is, in the illustrated embodiment, perforated and has orifices 6 arranged in the downstream part of its length. There is also provided an outlet or downstream tube 7 disposed in the case parallel to the inlet tube and also perforated at 8 in a first part of its length. By way of example, it might be mentioned that if the absorbent material is metallic there may be adopted for the orifices a diameter of 6 mm, these orifices being disposed in staggered relation and placed 60 mm apart in the longitudinal direction and 9 mm apart in a cross section of the tube. If the absorbent material is basalt wool, the orifices preferably have a diameter of 3 mm and are separated by a distance of 5 mm.

The device is completed by an outer return tube 9 which may have, for example, the shape shown in the drawing and connects the downstream end of the upstream tube 5 to the upstream end of the downstream tube 7 and forms two preferably identical elbows 9*a* and 9*b* interconnected by an intermediate part 9*c* which may be rectilinear, corrugated or helical or have any other shape, depending on the characteristics it is desired to obtain.

If sections corresponding respectively to the place of the orifice 6 located at the extreme downstream position on the upstream tube 5 and to the place of the orifice 8 located at the extreme upstream position on the downstream tube 7 are designated $A_1$ and $B_1$, and if the distance between the two sections is designated $L_1$ and the length of the path between the point $A_1$ and the point $B_1$ is designated $L_2$, by following the outer return tube, it can be seen that, owing to the presence of this outer return tube which channels the whole of the exhaust flow in the illustrated embodiment, there are introduced in the different paths of the waves a maximum difference of travel which is equal to $L_1 + L_2$, whereas the maximum inner difference of travel produced by the upstream and downstream tubes is only $2L_1$ and is therefore less than $L_1 + L_2$. This increase in the difference of travel permits acting on a wider frequency band and acting by interference in a more effective manner on the low frequencies, that is to say the low notes. Moreover, this result is obtained with a minimum pressure drop bearing in mind that the gases travel through the outer return tube with a minimum pressure drop.

Figure 2:
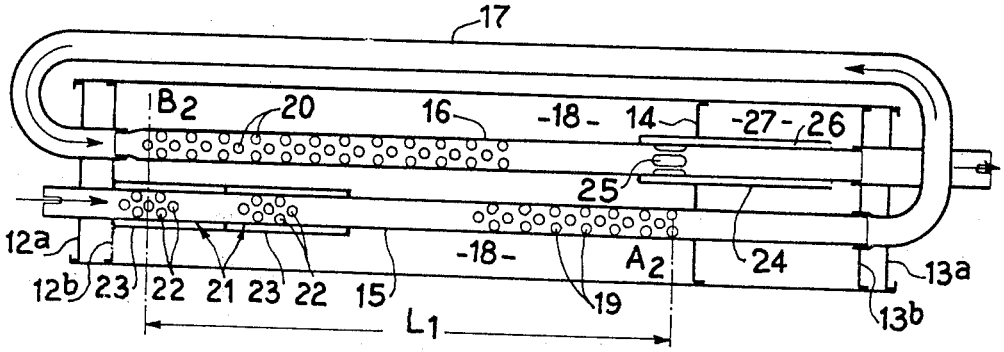

In the embodiment shown in FIG. 2, there is shown an intermediate silencer which is adapted to be placed at an intermediate point of the exhaust pipe and comprises a case 11 closed at both ends by walls 12*a*, 12*b*, 13*a*, 13*b* and further comprising in this embodiment an intermediate wall 14.

The silencer comprises, as before, an inlet or upstream tube 15 and an outlet or downstream tube 16 interconnected by an outer return tube 17 comparable to that of FIG. 1. In the region of the case located between the two walls 12*b* and 14, there is formed an intercommunication chamber 18, the inlet tube 15 and outlet tube 16 having in this region suitable perforations 19, 20. The orifices 19 are disposed in the portion of the tube 15 in the vicinity of the right end of the intercommunication chamber 18 and the orifices 20 are formed in the part of the tube 16 located in the vicinity of the left end of this chamber, as viewed in FIG. 2.

The orifices 19 preferably represent a maximum of 110% of the section of flow and preferably have a diameter of 4 mm. The orifices 20 also have this diameter and advantageously represent a maximum of 130% of the section of flow of the tube 16.

The inlet tube 15 has, in the presently-described embodiment, two very high-frequency inlet resonators 21 whereby it is possible to suppress the high note emissions through the case, these resonators or mufflers being of the reflection type and comprising orifices 22 opening into the chambers 23 disposed concentrically with the inlet tube.

There is also provided on the outlet tube a low-frequency resonator 24 which is based either on the fundamental frequency of the pipe connecting the engine to the silencer or on another critical frequency of the exhaust line. This resonator is constituted by elongated openings 25 which open into a collar 26 which is disposed concentrically with respect to the outlet tube and opens at its downstream end into the chamber 27 formed between the walls 13*b* and 14.

The sections in which the orifice 19 which is the extreme downstream orifice of the upstream tube and the orifice 20 which is the extreme upstream orifice of the downstream tube are respectively located will be designated $A_2$ and $B_2$, $L_1$ and $L_2$ having the same significations as in the embodiment shown in FIG. 1.

Apart from the specific differences which result from the very function desired in such an intermediate silencer, the advantages obtained and the function of the outer return tube are fundamentally the same as those which have been described with reference to the embodiment shown in FIG. 1. Indeed, the maximum difference of travel, equal to $L_1 + L_2$, exceeds the maximum internal difference of travel $2L_1$ between the inlet tube and outlet tube. As before, the shape and the constitution of the outer return tube and its disposition with respect to the case may be chosen in any suitable manner depending on the characteristics it is desired to obtain.

Figure 3:
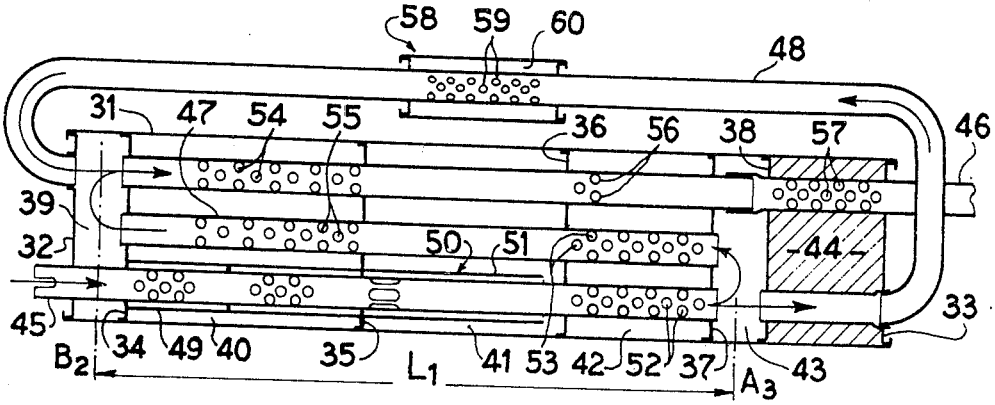

The embodiment shown in FIG. 3 is more complex and concerns an end silencer comprising an outer case 31 closed at its two ends by two covers 32 and 33 and comprising five intermediate partition walls 34, 35, 36, 37, 38 defining therebetween and with the covers six chambers 39, 40, 41, 42, 43 and 44.

The device further comprises an inlet tube 45 whose downstream end opens into the chamber 43, an outlet tube 46 whose upstream end opens into the chamber 39, an intermediate tube 47 whose upstream and downstream ends open respectively into the two chambers 43 and 39, and an outer return tube 48 whose upstream end opens into the chamber 43 in the extension of the inlet tube 45, whereas its downstream end opens into the chamber 39 in alignment with the outlet tube 46.

The inlet tube comprises, in its left portion as viewed in FIG. 3, two high-frequency resonators 49 and a low-frequency resonator 50 including a collar or throat 51 disposed concentrically with respect to the inlet tube and opening into the chamber 41. It further comprises a series of orifices 52 disposed in the region of the chamber 42 and facing orifices 53 formed in the intermediate tube 47. The latter and the outlet tube each comprise a series of orifices 54, 55 disposed in the chamber 40 and performing the same function as the orifices 52 and 53. The outlet tube has a second series of orifices 56 opening into the chamber 42 and a third series of orifices 57 opening into the end chamber 44 in which an absorbent material may be provided. Note that by way of a modification this absorbent material may be dispensed with and there may be provided instead of this stage of absorption an outlet stage employing reflection provided with a special perforation which is moreover known per se and need not be described here and precludes the whistling sound produced by a conventional perforation.

In this embodiment, there is provided on the outer return tube 48 an acoustic element 58 employing reflection comprising orifices 59 formed in this outer tube and a reflection chamber 60, this acoustic element being adapted either to suppress certain undesirable stationary waves or to perform the function of a phase shifter.

This embodiment permits obtaining a range of differences of travel the greatest of which, obtained inside the silencer, is equal to 2 $L_1$, $L_1$ being the distance between two points $A_3$ and $B_3$ corresponding to the mean sections of the balancing chambers 39 and 43. Added to this is the difference of travel corresponding to the path from $A_3$ to $B_3$ along the outer return tube, which difference of travel is equal to $L_1 + L_2$ in which $L_2$ represents this path from $A_3$ to $B_3$ through the outer return tube 48.

It can be seen that in this embodiment the flow of the gases reaching the chamber 43 by way of the inlet tube is divided into two streams, a stream which travels through the outer path by way of the return tube 48 and a stream which travels through the intermediate tube 47, the two streams being mixed again in the region of the chamber 39. This embodiment permits obtaining a remarkable effectiveness in a very important range of frequencies while maintaining the pressure drop at a very low value.

Figure 4:
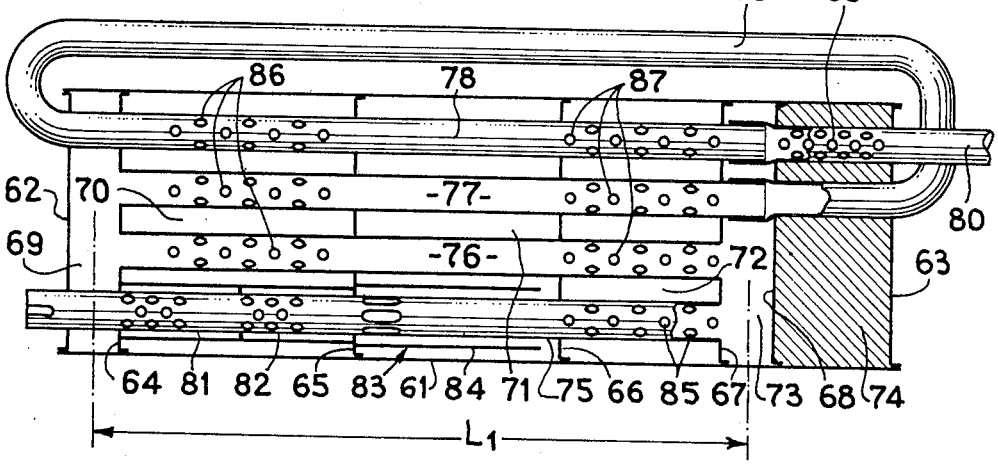

FIG. 4 shows a silencer comprising a case 61 closed at both ends by two covers 62 and 63 and having five intermediate partition walls 64, 65, 66, 67 and 68 defining therebetween and with the covers six chambers 69, 70, 71, 72, 73 and 74.

The device comprises four tubes 75, 76, 77, 78 disposed within the case, the first three tubes being placed in series whereas the downstream end of the tube 77 is connected by an outer return tube 79 to the upstream end of the last tube 78 connected to an outlet pipe 80. The first or inlet tube 75 comprises, first, two high-frequency resonators 81, 82 and a low-frequency resonator 83 comprising a collar or throat 84 disposed concentrically with respect to the tube 75 and opening into the chamber 71. The other three tubes are practically identical and have in the region of the chambers 70 and 72 perforations 86, 87 so as to constitute with the first tube an interference and reflection system. The outlet tube is moreover perforated at 89 in the region of the chamber 74 which may be filled with a suitable absorbent material.

Figure 5:
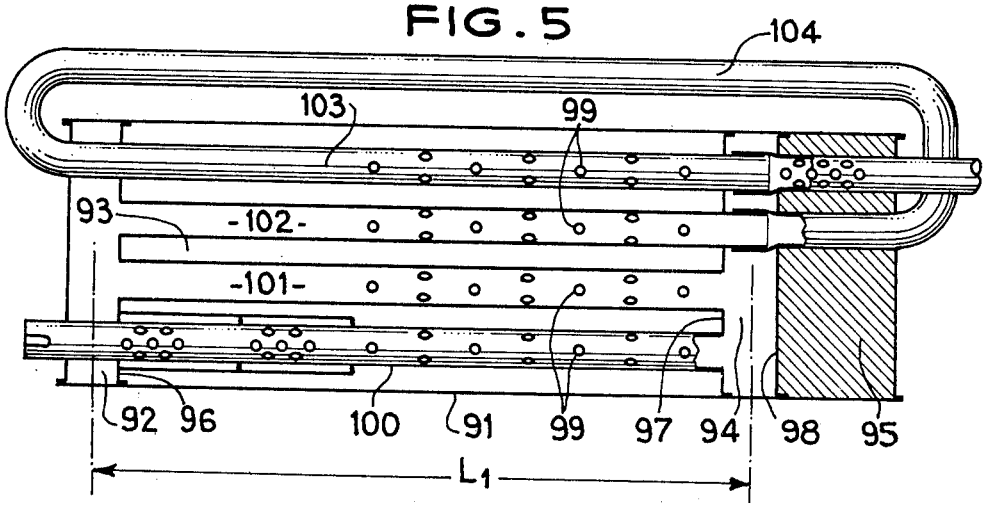

In the silencer shown in FIG. 5, which corresponds on the whole to the same design as that shown in FIG. 4, certain simplifications have however been made, the case 91 being merely divided into four chambers 92, 93, 94, 95 by three intermediate partition walls 96, 97, 98. It will also be observed that the inlet tube no longer has a low-frequency resonator and that the distribution of the perforations 99 in the four tubes 100, 101, 102, 103 is different from that provided in the embodiment shown in FIG. 4. The outer return tube is designated by the reference numeral 104.

Preferably, in these last two embodiments, the total section of the perforation for each one of the four inner tubes of the silencer represents about between 100 and 300 % of the section of gas flow of these tubes.

Without going into the details of operation of these silencers, it will merely be mentioned that if $L_1$ represents the distance between the mean sections of the two balancing chambers 69, 73 and 92, 94 and if $L_2$ represents the length of the path in the outer return tube between these two sections, the range of the differences of travel obtained by means of the system extends from 0 to 2 $L_1$ owing to the presence of the first three tubes which constitute an interference and reflection assembly to which there is added a length $L_1 + L_2$ corresponding to the path in the outer return tube and in the fourth tube 78, 103. The maximum difference of travel is therefore equal to 3 $L_1 + L_2$.

In this way there is obtained an improved distribution of the differences of travel and an additional increase in the range of frequencies concerned without however increasing the pressure drop which remains lower than that of a system having four tubes of equivalent acoustic characteristics whose length would be substantially greater and which would moreover have the drawback of having the outlet at the same end as the inlet. Moreover, the described device benefits from the extremely developed interference effect and lends itself to gas flow sections greater than that which could be adopted in a silencer having three tubes. Consequently, the pressure drop obtainable with this novel arrangement is lower than that of an acoustically equivalent system having three tubes whose length would be greater than that of the equivalent system having four tubes mentioned hereinbefore.

Briefly, these two embodiments have the advantage of a high acoustic effectiveness and a pressure drop lower than that of known systems having a plurality of tubes.

The gain obtained by means of the invention in the damping or muffling of noise may be put at several decibels over the most efficient known devices. Moreover and jointly, the pressure drop may be reduced by one half or even more. These values are significant of the interest of this arrangement.

It will be understood that many modifications may be made to the five embodiments described and illustrated which have been given merely by way of examples. Thus, in particular, these modifications may concern, as mentioned hereinbefore, the shape and the disposition of the outer return tube and the position, the diameters and the functions of the various resonators or attenuators provided on the inlet tube, outlet tube, intermediate tube or outer tube. Moreover, this notion of outer return tube must be understood in a broad sense. This tube could always be enclosed in a covering case of sufficiently large size, the essential being that this return tube permit the introduction of a difference of travel which is greater than that obtained by means of two or three parallel perforated tubes disposed inside the case, with the lowest possible pressure drop.

The invention also relates to any combination obtained with silencers comprising these fundamental characteristics and also silencers comprising more than one inlet tube and/or more than one outlet tube.

Having now described my invention what I claim as new and desire to secure by Letters Patent is:

1. An exhaust silencer for a heat engine comprising in combination a closed case, at least two perforated tubes extending in said case, namely an upstream tube and a downstream tube with respect to the direction of flow of the exhaust gases and through which tubes exhaust gases travel in series, and an outer return tube outside the case through which return tube at least a fraction of the exhaust gas stream travels, the return tube being part of means for putting a downstream end of the upstream tube and an upstream end of the downstream tube in communication with each other.

2. A silencer as claimed in claim 1, wherein the upstream tube and downstream tube extend throughout the length of the case and the outer return tube is directly connected to the downstream end of the upstream tube and to the upstream end of the downstream tube.

3. A silencer as claimed in claim 1, wherein means define a chamber within the case and the perforations of the upstream tube are offset toward the downstream end of the upstream tube and the perforations of the downstream tube are offset toward the upstream end of the downstream tube, said perforations opening into said chamber.

4. A silencer as claimed in claim 3, further comprising an absorbent material in said chamber.

5. A silencer as claimed in claim 1, wherein the upstream tube comprises at least one high-frequency attenuator.

6. A silencer as claimed in claim 1, wherein the upstream tube comprises at least one low-frequency resonator.

7. A silencer as claimed in claim 1, wherein the downstream tube comprises a low-frequency resonator stage employing reflection.

8. A silencer as claimed in claim 1, wherein the downstream tube comprises an attenuator stage employing absorption.

9. A silencer as claimed in claim 1, wherein the outer return tube comprises at least one additional acoustic stage.

10. An exhaust silencer for a heat engine comprising in combination a closed case, at least two perforated tubes extending in said case, namely an upstream tube and a downstream tube with respect to the direction of flow of the exhaust gases and through which tubes exhaust gases travel in series, and an outer return tube outside the case through which return tube at least a fraction of the exhaust gas stream travels, means defining in the case two balancing chambers, at least one interconnection chamber, and at least one intermediate tube in the case, a downstream end of the upstream tube, an upstream end of the intermediate tube and an upstream end of the outer return tube opening into a first of said balancing chambers, a downstream end of the intermediate tube, a downstream end of the outer return tube and an upstream end of the downstream tube opening into a second of said balancing chambers.

11. A silencer as claimed in claim 10, wherein the upstream tube, the intermediate tube and the downstream tube have orifices which open into the intercommunication chamber which is located in the vicinity of the first balancing chamber.

12. A silencer as claimed in claim 10, comprising a second interconnection chamber, the intermediate tube and the downstream tube having perforations which open into the second intercommunication chamber which is adjacent the second balancing chamber.

13. A silencer as claimed in claim 10, wherein the two ends of the outer return tube are respectively in alignment with the adjacent ends of the upstream tube and downstream tube.

14. An exhaust silencer for a heat engine comprising in combination a closed case, at least two perforated tubes extending in said case, namely an upstream tube and a downstream tube with respect to the direction of flow of the exhaust gases and through which tubes exhaust gases travel in series, and an outer return tube outside the case through which return tube at least a fraction of the exhaust gas stream travels, the return tube being part of means for putting a downstream end of the upstream tube and an upstream end of the downstream tube in communication with each other, an interference and reflection system being placed in the case in series with the upstream tube, which upstream tube is connected to the outer return tube.

15. A silencer as claimed in claim 16, wherein the interference and reflection system comprises two tubes which are placed in series with respect to each other upstream of the upstream tube with respect to the flow of the exhaust gases and are each provided with at least one series of perforations opening into at least one chamber defined in the case.

16. A silencer as claimed in claim 15, wherein the upstream tube and downstream tube have perforations substantially corresponding to the perforations of the tubes of the interference and reflecting system with which system they are arranged in series.

17. A silencer as claimed in claim 14, wherein the perforations of each one of the tubes have a total section which is substantially between 100 and 130 % of the gas flow section of the considered tube.

* * * * *